US006261512B1

(12) United States Patent
Donze et al.

(10) Patent No.: US 6,261,512 B1
(45) Date of Patent: Jul. 17, 2001

(54) OXYACETYLENE CUTTING APPARATUS

(76) Inventors: Michel Donze, La Flie, 54460 Liverdun; Guy Prioretti, 13 rue Alexandre Dreux, 57100 Thionville, both of (FR)

( * ) Notice: Subject to any disclaimer, the term of this patent is extended or adjusted under 35 U.S.C. 154(b) by 0 days.

(21) Appl. No.: 09/424,072

(22) PCT Filed: May 14, 1998

(86) PCT No.: PCT/FR98/00961

§ 371 Date: Feb. 2, 2000

§ 102(e) Date: Feb. 2, 2000

(87) PCT Pub. No.: WO98/53250

PCT Pub. Date: Nov. 26, 1998

(30) Foreign Application Priority Data

May 20, 1997 (FR) ..... 97 06108

(51) Int. Cl.[7] ..... B23K 7/00
(52) U.S. Cl. ..... 266/48
(58) Field of Search ..... 266/48, 49; 148/194

(56) References Cited

U.S. PATENT DOCUMENTS 1,495,164 * 5/1924 Coberly ..... 266/48
3,934,818 1/1976 Arnold .
4,468,007 * 8/1984 Dillon ..... 266/48

FOREIGN PATENT DOCUMENTS

2635284 * 2/1990 (FR) ..... 266/48
96/18071 6/1996 (WO) .
96/26806 9/1996 (WO) .

* cited by examiner

*Primary Examiner*—Scott Kastler
(74) *Attorney, Agent, or Firm*—Nixon Peabody LLP; Stuart J. Friedman

(57) ABSTRACT

The oxy-cutting torch comprises a support element (10) made from an undeformable block of stainless steel, and a heater element (20) permanently fixed against a bottom face (19) of the support element (10), which heater element is made from a solid block of copper in which passages are formed for gases and cooling fluid, which passages communicate directly with corresponding pipes of the support element (10). At least one nozzle (30) is positioned with precision in two bores (41, 32) in axial alignment provided respectively in the support element (10) and in the heater element (20), the nozzle being connected to a cutting oxygen feed pipe (14.6). A holder element (40) is preferably used to improve the precision with which the nozzle (30) is positioned.

7 Claims, 2 Drawing Sheets

OXYACETYLENE CUTTING APPARATUS

FIELD OF THE INVENTION

The present invention relates to the field of oxy-cutting torches.

BACKGROUND OF THE INVENTION

Most presently known torches comprise a nozzle having a cutting orifice and a plurality of heating orifices. The cutting orifice serves to bring a flow of cutting oxygen to the workpiece, while the heating orifices enable the workpiece for cutting to be heated by burning a fuel gas in the heating oxygen. To illustrate the technological background, reference can be made to the following documents: DE-A-14 29 136, FR-A-444 349, DE-C-249 170, DE-B-12 09 973, and FR-E-9375. Reference can also be made to document U.S. Pat. No. 3 934 818 which shows an oxy-cutting torch fitted with a cooling system for spraying an air and water mixture of adjustable composition.

More recent techniques are illustrated in documents WO 96/18071 and WO 96/26806.

Although oxy-cutting methods using oxy-cutting torches are in widespread use in various stages of steelworking, it appears that the design and the materials used do not enable high precision to be obtained for machining purposes, even though ever greater precision is being required ever more frequently, and above all traditional torches continue to be tools that are fragile compared with their environment, which gives rise to high maintenance costs and to losses of production. In particular, torch nozzles are generally positioned relatively imprecisely on their supports which are generally made of copper, and such supports are moved frequently in operation, possibly with jolting. Consequently, the imprecise positioning, which deteriorates as use continues, gives rise to losses of throughput. When one or more nozzles are used simultaneously, these variations in positioning have an effect that is particularly harmful insofar as the various jets from the nozzles run the risk of interfering with one another, which naturally harms the efficiency of the action of such jets.

SUMMARY OF THE INVENTION

The invention seeks specifically to resolve that problem by designing oxy-cutting equipment which is simultaneously robust so as to guarantee precision over time in spite of the thermal constraints of the environment, while also making it possible for maintenance to be simple, practical, and fast so as to take account of production requirements, while simultaneously optimizing manufacturing and running costs and also keeping intervention times down to a minimum.

An object of the invention is thus to provide an oxy-cutting torch which presents simultaneously the advantages of high precision, long life, and easy disassembly.

According to the invention, this problem is resolved by an oxy-cutting torch comprising a support element made of an undeformable block of material that can be machined with precision, said support element including integrated pipes for feeding heater and make-up gases and cooling liquid, and a heater element permanently fixed against a bottom face of the support element, said heater element being made of a solid block in which passages are formed for the gases and cooling fluid, which passages communicate directly with the corresponding pipes of the support element, and at least one nozzle positioned with precision in two bores in axial alignment provided respectively in the support element and the heater element, said nozzle opening out in the free face of the heater element and being connected to a pipe for feeding it with cutting oxygen.

Preferably, the torch comprises a holding element for positioning the nozzle precisely, said element passing in an associated bore in the support element and covering that portion of the nozzle which is in said support element. In particular, the holding element covers the nozzle via a terminal bore thereof which connects with a bearing shoulder co-operating with the upstream edge of the nozzle, which nozzle has on its outside a bearing shoulder for bearing against the heater element.

Also preferably, the holding element is fixed on the support element by quick-fixing means, and said holding element also has an inlet bore associated with the connection of the cutting oxygen feed pipe.

Also advantageously, the pipes and passages for cooling liquid are organized to pass close to the nozzle. Thus, the cooling circuit which is common to the base element and to the heating element, enables stable thermal conditions to be ensured for the cutting oxygen nozzle(s) integrated in the mechanical assembly that is regularly cooled in this way.

Finally, and preferably, the support element is made of stainless steel and the heater element of copper, the nozzle being made of a suitable material such as copper, brass, or ceramic.

DESCRIPTION OF THE DRAWINGS

Other characteristics and advantages of the invention appear more clearly in the light of the following description and the accompanying drawings which relate to a particular embodiment, and in which.

DESCRIPTION OF THE PREFERRED EMBODIMENTS

Figure 1:
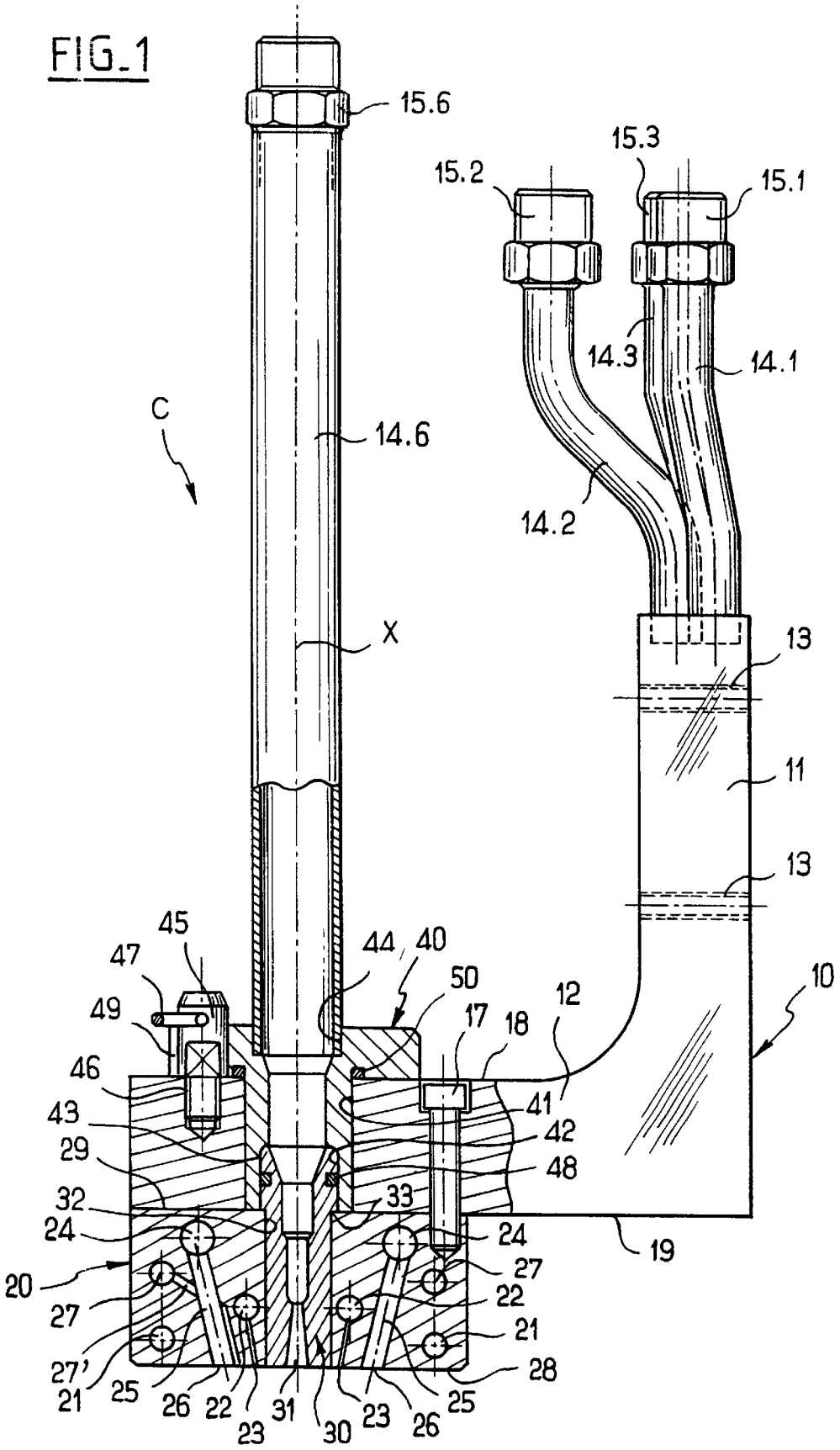
FIG. 1 shows an oxy-cutting torch of the invention, the main portion of said torch being shown in section so as to show more clearly how the associated high precision nozzle is positioned.
Figure 2:
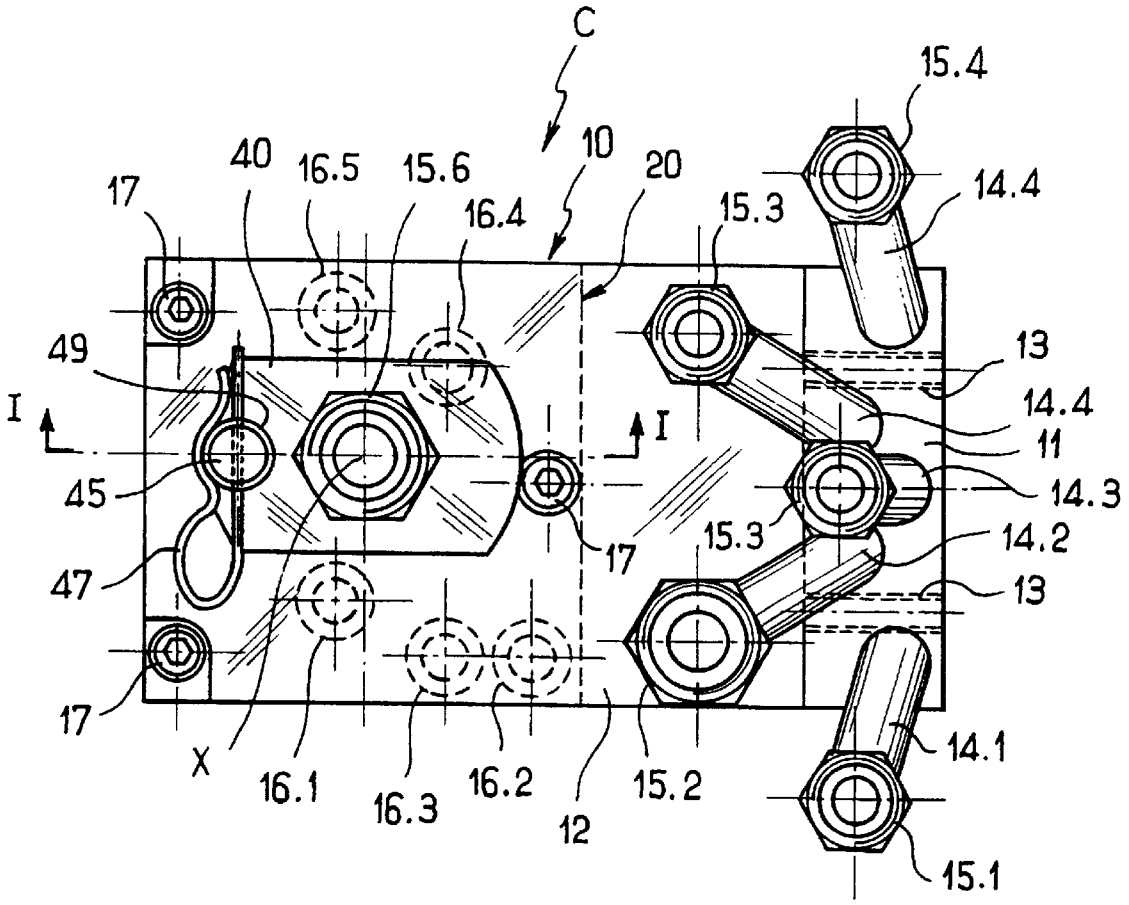
FIG. 2 is a plan view of the above oxy-cutting torch, FIG. 1 being a section on I—I of FIG. 2.

FIGS. 1 and 2 show an oxy-cutting torch C mainly comprising a support element referenced 10 which has permanently fixed thereto at least one heater element referenced 20.

In this case, the support element 10 has a vertical connection branch 11 and a substantially horizontal foot 12. This one-piece unit is made from an undeformable block of material that can be machined with precision, for example stainless steel. The branch 11 has holes 13 enabling the oxy-cutting torch C to be fixed on a positioning device which can be constituted, for example, by a hinged system. Various pipes referenced 14.1 to 14.5 are connected to the top of the branch 11 of the support element 10. In this case there is a set of five pipes, but the invention is naturally not limited to a particular number of such pipes. Specifically, the pipe 14.1 corresponds to an inlet for cooling water, e.g. water, the pipe 14.2 corresponds to a make-up gas feed, the pipe 14.3 corresponds to a heating oxygen feed, the pipe 14.4 corresponds to a fuel gas feed, and the pipe 14.5 corresponds to a cooling liquid outlet. Each of the pipes is surmounted by a respective endpiece 15.1 to 15.5 enabling it to be connected to external pipework (not shown). These pipes for feeding make-up gas and heating gas and cooling liquid extend inside the support element 10 in the form of passages (not shown) which open out in the bottom face referenced 19 of the foot 12 via respective outlet orifices referenced 16.1 to 16.5 and visible in FIG. 2. The above-mentioned pipework is thus integrated in this sense within the support element 10.

The heater element, referenced 20, is permanently fixed, in this case by three screws 17 against the bottom face 19 of the support element 10. The heater element 20 is made of a solid block, e.g. of copper, through which passages 21, 22, 24, and 27 are formed for the heating and make-up gases and for the cooling fluid, which passages communicate directly with the corresponding pipes of the support element 10. Thus, the passages 21 correspond to the water cooling circuit, the passages 22 correspond to the make-up gas, which gas passes via associated channels to open out via orifices 23 in the free face referenced 28 of the heater element 20. The passages 34 correspond to the fuel gas, and exit from the heater element via associated channels 25 opening out at orifices 26. Finally, the passages 27 correspond to heating oxygen, which passes via small associated channels 27' that connect with the above-mentioned channels 25. It will be observed that the above-mentioned outlet channels are organized conically around a central axis X which is the axis of a nozzle described below. The orifices 23 and 26 are disposed in two concentric circles around the outlet orifice of the nozzle.

The top face of the heater element 20 which is pressed against the bottom face 19 of the foot 12 that forms a portion of the support element 10 is referenced 29. Pressing the faces against each other in this way makes it possible to provide direct connections between the various pipes and the corresponding passages between the support element 10 and the heater element 20.

The oxy-cutting torch C also has at least one nozzle 30 that can be seen more clearly in the section of FIG. 1. This nozzle 30 is connected in entirely conventional manner to a pipe 14.6 for feeding it with cutting oxygen, and it opens out via an orifice 31 in the free face 28 of the heater element 20.

However the way the nozzle 30 is positioned is entirely original, and it makes it possible for the axis X of the nozzle to be set extremely precisely relative to the support element 10 which is an undeformable block.

The nozzle 30 is generally positioned with precision in two axially aligned bores 41 and 32 that are provided respectively in the support element 10 and in the heater element 20.

Specifically, it can be seen that the nozzle passes directly into the bore 32 of the heater element 20, but that in contrast it does not come directly into contact with the bore 41 formed in the support element 10. A holder element referenced 40 is used for this purpose which fits in said bore 41 of the support element 10, which holder element 40 covers that portion of the nozzle 30 which is inside the support element 10. More precisely, the holder element 40 covers the nozzle 30 by means of an end bore 42 thereof which is connected to a bearing shoulder referenced 43 co-operating with the upstream edge of the nozzle 30. The portion (in this case the top portion) of the nozzle 30 which is inside the support element 10 is thus positioned exactly in the associated bore 42 of the element 40, which element is itself positioned exactly in the bore 41 of said support element. Thus, by having a sufficient height of the bore 41 covering the nozzle 30, it is possible to ensure that the axis X is set exactly. The nozzle 30 also has an external bearing shoulder referenced 33 and bearing against the heater element 20, i.e. in this case against the top face 29 of said heater element. A gasket provides sealing for the cutting oxygen arriving via the pipe 14.6 which is surmounted by a connection endpiece 15.6. A gasket 50 is also provided to provide sealing between the enlarged portion of the element 40 and the top face 18 of the foot 12 of the support element 10. The holding element 40 also has an inlet bore referenced 44 associated with the connection of the pipe 14.6 for feeding cutting oxygen.

The use of such a holder element guarantees very high precision for the positioning of the nozzle 30. In addition, because of the cooling circuit which is common to the support element 10 and to the heater element 20, excellent temperature protection is obtained for the nozzle 30 which is thus surrounded over its entire outside surface by an assembly which is maintained at a uniform temperature, thereby guaranteeing longer life. In addition, because of the effective cooling that is obtained of the heater element 20, the free face 28 of this element represents a surface that is cold even while the oxy-cutting torch is in operation, such that any slag spattered in the liquid state cannot adhere to this surface, unlike traditional heater elements which are not protected against brazing directly to spattered slag. This immunization against spattered liquid slag is naturally most favorable in avoiding any risk of clogging the outlet orifices 23, 26, and 31 which are to be found in the free face 28 of the heater element 20. As an indication, the means used for precisely positioning the nozzle 30 make it easy to obtain precision of less than 100th of a millimeter.

To make disassembly easy, which is of great importance in practice, it is advantageous to provide for the above-mentioned holding element 40 to be fixed on the support element 10 by quick-fixing means. A screw with a cotter pin or a spring clip can be used as quick-fixing means suitable for being operated without tooling. Specifically, the drawing shows quick-fixing means comprising a screw having a cylindrical head 45 that is screwed into associated tapping 46 in the foot 12 of the support element 10, the head 45 being received in a semicircular notch in the element 40 and referenced 49. The associated cotter pin passing through a hole passing laterally through the head 45 is referenced 47. As can easily be understood, disassembly is extremely quick since it suffices to remove the pin 47 in order to be able to extract the element 40 and consequently to gain access to the nozzle 30. These operations are naturally performed without undoing the mechanical connection between the support element 10 and the heater element 20. In addition, reassembly is easy with the nozzle being positioned with the same precision. The nozzle 30 is preferably made of a suitable material such as copper, brass, or ceramic. To improve the cooling of the nozzle, it is advantageous to provide for the pipes and the holes for cooling liquid to be organized so as to pass close to the nozzle 30. Specifically, with reference to the plan view of FIG. 2, orifices 16.1 and 16.5 can thus be seen which are respectively associated with the cooling water inlet and outlet (these orifices being disposed on either side of the axis X), and there can also be seen the orifice 16.2 associated with the make-up gas feed, the orifice 16.3 associated with the heating oxygen feed, and the orifice 16.4 associated with the fuel gas feed.

Finally, the stainless support element makes it possible simultaneously to machine a mechanical link that is very precise and that remains undeformable even when subjected to shock, while serving to distribute the fluids concerned to the various elements that are themselves securely fixed in very precise manner to said support element. The heater element is constituted by one or more burners (the figures show a variant having a single burner, but that is naturally only an example). The cooling by the water circuit common to the water circuit of the support element enables the heater element to withstand large temperature differences without damage, and as mentioned above, it enables it to withstand any spattering of liquid slag that might take place during cutting that misfires.

At least one independent cutting oxygen nozzle is used, which nozzle is, practically speaking, "buried" in the mass of the support element in one or more associated housings that are mechanically positioned very precisely relative to the machining of the support element link. The or each nozzle thus remains at the constant temperature of the cooled solid assembly, thereby also enabling the precision with which they were manufactured to be preserved in spite of thermal stresses of the environment, and thus preserving performance.

An oxy-cutting torch is thus provided which provides extremely high performance, avoiding the conventional defects of traditional oxy-cutting torches, and avoiding in particular the impossibility of producing parts that are finished to mechanical machining tolerances, and the poor resistance to the exceptionally tough constraints of an oxy-cutting environment integrated in mass production steel-making methods. This also avoids losses in productivity associated with time wasted unavoidably for changing the nozzles of conventional torches.

The invention is not limited to the embodiment described above, but on the contrary it covers any variant that uses equivalent means to reproduce the essential characteristics specified above.

What is claimed is:

1. An oxy-cutting torch comprising a support element in the form of an undeformable block of material that can be machined with precision, said support element including integrated pipes for feeding heater and make-up gases and cooling liquid, and a heater element permanently fixed against a bottom face of the support element, said heater element being in the form of a solid block in which passages are formed for the gases and cooling fluid, which passages communicate directly with the corresponding pipes of the support element, and at least one nozzle positioned with precision in two bores in axial alignment provided respectively in the support element and the heater element, said nozzle opening out in a free face of the heater element and being connected to a pipe for feeding it with cutting oxygen.

2. A torch according to claim 1, comprising a holding element for positioning the nozzle precisely, said element passing in an associated bore in the support element and covering that portion of the nozzle which is in said support element.

3. A torch according to claim 2, wherein the holding element covers the nozzle via a terminal bore thereof which connects with a bearing shoulder co-operating with the upstream edge of the nozzle, which nozzle has on its outside a bearing shoulder for bearing against the heater element.

4. A torch according to claim 2, wherein the holding element is fixed on the support element by quick-fixing means.

5. A torch according to claim 2, wherein the holding element also has an inlet bore associated with the connection of the cutting oxygen feed pipe.

6. A torch according to claim 1, wherein the pipes and passages for cooling liquid are organized to pass close to the nozzle.

7. A torch according to claim 1, wherein the support element is made of stainless steel and the heater element of copper, the nozzle being made of a material selected from the group consisting of copper, brass, and ceramic.

* * * * *